US009316045B2

(12) United States Patent
Kim

(10) Patent No.: US 9,316,045 B2
(45) Date of Patent: Apr. 19, 2016

(54) WINDOW AND DOOR SYSTEM HAVING EASILY CHANGEABLE STRUCTURE

(71) Applicant: IDA CO., LTD., Paju-si, Gyeonggi-do (KR)

(72) Inventor: Soon Seok Kim, Paju-Si (KR)

(73) Assignee: IDA CO., LTD., Paju-Si, Gyeonggi-Do (KR)

( * ) Notice: Subject to any disclaimer, the term of this patent is extended or adjusted under 35 U.S.C. 154(b) by 0 days.

(21) Appl. No.: 14/430,223

(22) PCT Filed: Aug. 22, 2013

(86) PCT No.: PCT/KR2013/007520

§ 371 (c)(1),
(2) Date: Mar. 22, 2015

(87) PCT Pub. No.: WO2014/046388

PCT Pub. Date: Mar. 27, 2014

(65) Prior Publication Data

US 2015/0247358 A1 Sep. 3, 2015

(30) Foreign Application Priority Data

Sep. 24, 2012 (KR) ..... 10-2012-0105793

(51) Int. Cl.

| | |
|---|---|
| ***E05F 1/00*** | (2006.01) |
| ***E06B 7/26*** | (2006.01) |
| ***E05B 63/00*** | (2006.01) |
| ***E05B 65/08*** | (2006.01) |
| ***E05B 15/02*** | (2006.01) |
| ***E06B 3/46*** | (2006.01) |

(Continued)

(52) U.S. Cl.
CPC . *E06B 7/26* (2013.01); *E05B 1/003* (2013.01); *E05B 15/0205* (2013.01); *E05B 63/0056* (2013.01); *E05B 65/08* (2013.01); *E05D 15/0621* (2013.01); *E06B 3/34* (2013.01); *E06B 3/4609* (2013.01); *E06B 3/4618* (2013.01); *E06B 3/4636* (2013.01); *E06B 7/18* (2013.01); *E06B 7/28* (2013.01); *E06B 1/62* (2013.01); *E06B 3/26347* (2013.01); *E06B 3/469* (2013.01); *E06B 9/52* (2013.01)

(58) Field of Classification Search
CPC ..... E06B 7/26; E06B 7/28; E06B 3/34; E06B 7/18; E06B 3/4636; E06B 3/4618; E05B 1/003; E05B 63/0056; E05B 15/0205; E05B 65/08; E05D 15/0621
USPC ..... 49/449, 458, 453, 454, 456, 457
See application file for complete search history.

(56) References Cited

U.S. PATENT DOCUMENTS 4,037,378 A * 7/1977 Collins et al. ..... 52/204.591
2012/0255230 A1* 10/2012 Smith et al. ..... 49/257

FOREIGN PATENT DOCUMENTS

GB 2496993 A * 5/2013
JP 09287333 11/1997

(Continued)

*Primary Examiner* — Jerry Redman
(74) *Attorney, Agent, or Firm* — Mark M. Friedman

(57) ABSTRACT

There is provided a window/door system having an easily changeable structure characterized in that: a striker holder connected to a striker to be laid in an installation space on a side jamb of a window or door frame, a finishing cap connected to the striker holder, to support the striker in the striker holder, the striker and the striker holder are laid in the installation space between frame rails, not to protrude into a passage space of the window or door frame.

9 Claims, 16 Drawing Sheets

(51) Int. Cl.

| | |
|---|---|
| ***E05D 15/06*** | (2006.01) |
| ***E05B 1/00*** | (2006.01) |
| ***E06B 3/34*** | (2006.01) |
| ***E06B 7/18*** | (2006.01) |
| ***E06B 7/28*** | (2006.01) |
| *E06B 1/62* | (2006.01) |
| *E06B 3/263* | (2006.01) |
| *E06B 9/52* | (2006.01) |

(56) References Cited

FOREIGN PATENT DOCUMENTS

| | | |
|---|---|---|
| KR | 1020070066830 | 6/2007 |
| KR | 100866997 | 11/2008 |
| KR | 1020100043426 | 4/2010 |
| KR | 1020100071139 | 6/2010 |
| KR | 1020110006082 | 1/2011 |
| KR | 101082321 | 11/2011 |

* cited by examiner

WINDOW AND DOOR SYSTEM HAVING EASILY CHANGEABLE STRUCTURE

CROSS-REFERENCE TO RELATED APPLICATION

This application claims the benefit of Korean Patent Application No. 10-2012-0105793, filed on Sep. 24, 2012, the disclosure of which is hereby incorporated herein by reference in its entirety.

BACKGROUND OF THE INVENTION

1. Field of the Invention

The present invention relates to a window/door system having an easily changeable structure and more particularly, to a window/door system having an easily changeable structure, which is nice in appearance, prevents any accident when going in/out, and is easily changeable in structure from a slidable window/door to a fixed window/door, vice versa (from a fixed window/door to a slidable window/door) by a very simple change.

2. Description of the Related Art

Generally, a window and door system (hereinafter, referred to as a 'window/door') installed in a building essentially includes a window, a door, a window/door frame in which the widow and door are installed, which is slidable to an opened/closed position (hereinafter, referred to as a 'slidable window/door'). The window/door needs to be weatherproof which means it must be highly resistant to an outside weather, durable and have great mechanical properties to bear the weight of the glass.

These days, windows and doors are required to provide quality and functionality. Many different windows and doors have been developed, including a sliding window/door system in a living room, a lift sliding window system widely used for a relatively large window in a balcony, and a security window/door system having a security function.

A window/door frame of a conventional window/door system includes rail grooves receiving a slidable window/door to be opened or closed in a sliding motion. The rail grooves may obstruct or may be dangerous when people walk over the rail grooves. In the window/door frame used in a veranda, dust or any other foreign materials easily collect in the rail grooves and it is not easy to clean such dirty from the rail grooves. Also, when a draft or rainwater easily comes around the window/door frame used in the veranda and the rail grooves, air tightness and drainage are greatly reduced.

Further, in the conventional window/door system, the shape of the window/door frame is changed in line with a function of a window/door to be installed. When a window/door to be installed in the window/door frame is movable to enable opening/closing by a sliding motion, the window/door frame is provided with rails inside. When a window/door to be installed in the window/door frame is fixed, the window/door frame is provided with a proper structure inside, to secure the fixed window/door against moving.

Accordingly, there is a problem in that the structure of the window/door frame has to be changed based on a kind or function of a window/door installed in the conventional window/door system. Once the fixed window/door has been installed in the conventional window/door frame, it is impossible to open/close the fixed window/door or to fix the slidable window/door unless the entire window/door frame is replaced.

Another problem of the conventional window/door system exists in the structure of the striker. Generally, in a window/door system with a locking system, the striker protrudes inside the window/door frame, a lock is installed in a side facing the slidable window/door, to be attached to/detached from the striker, and a handle is installed in the front side of the slidable window/door to attach/detach the lock to/from the striker by operating the lock.

The striker of the conventional window/door system furthermore protrudes towards the glass rather than the rail end of the window/door frame. So, when a viewer sees the window/door from the inside, the viewer can see the striker protruding toward the glass. This deteriorates the appearance of the window/door system.

In addition, since the striker of the conventional door system furthermore protrudes towards the glass rather than the rail end of the door frame, when the door is used in a living room or veranda, the striker many cause an accident that people is hit by the striker when passing through the door.

SUMMARY OF THE INVENTION

Therefore, it is an object of the present invention to solve the above problems and to provide a window/door system having an easily changeable structure, which is nice in appearance and prevents any accident when going in/out.

It is another object of the present invention to provide a window/door system having an easily changeable structure, to change the structure, from a slidable window/door to a fixed window/door or from a fixed window/door to a slidable window/door, by very simple work.

In accordance with an embodiment of the present invention, there is provided a window/door system having an easily changeable structure comprising: a window/door frame with frame rails positioned around a passage space to allow people to enter/exit or to ventilate air, and an installation spaces formed between the frame rails; a striker to be installed in the installation space on a side jamb of the window/door frame; a slidable window/door installed to slide along the frame rails, the slidable window/door including a sash with installation channels formed on its both sides and a glass installed in the sash; a lock installed in the installation channel of the sash, to be attached/detached to/from the striker to attach/detach the slidable window/door to/from the window/door frame; and a handle installed in the sash and connected to the lock, to operate the lock to be attached/detached to/from the striker; a striker holder connected to the striker to be laid in the installation space on the side jamb of the window/door frame; and a finishing cap connected to the striker holder, to support the striker in the striker holder, wherein the striker and the striker holder are laid in the installation space between the frame rails, not to protrude into the passage space of the window/door frame.

In accordance with another embodiment of the present invention, there is provided a window/door system having an easily changeable structure comprising: a window/door frame with an installation spaces formed around a passage space to allow people to enter/exit or to ventilate air and; a striker to be installed in the installation space on a side jamb of the window/door frame; a slidable window/door installed to slide along the frame rails, the slidable window/door including a sash with installation channels formed on its both sides and a glass installed in the sash; a lock installed in the installation channel of the sash, to be attached/detached to/from the striker to attach/detach the slidable window/door to/from the window/door frame; and a handle installed in the sash and connected to the lock, to operate the lock to be attached/detached to/from the striker; a holder bracket connected to the striker to be laid in the installation space on the side jamb of the window/door frame; a striker holder connected to the holder bracket, to connect to the striker; a screw connected through the striker holder, the holder bracket and the window/door frame; and a finishing cap connected to the striker holder, to support the striker in the striker holder, wherein the striker, the striker holder and the holder bracket are laid in the installation space on the side jamb of the window/door frame, not to protrude into the passage space of the window/door frame.

In accordance with another embodiment of the present invention, there is provided a window/door system having an easily changeable structure comprising: a window/door frame providing a passage space to allow people to enter/exit or to ventilate air; a pair of fixed windows/doors installed to be fixed to either side jamb of the window/door frame; a pair of slidable windows/doors installed to slide in the window/door frame, to open/close the passage space between the slidable windows/doors, each of the slidable windows/doors including a sash with installation channels formed on its both sides and a glass installed in the sash; a striker holder connected to the sash of any one of the slidable windows/doors; a striker connected to the inside of the striker holder; a finishing cap connected to the striker holder, to support the striker in the striker holder; a lock installed in the installation channel of the other slidable window/door, to be attached/detached to/from the striker to attach/detach the one slidable window/door to/from the other slidable window/door; and a handle installed in the slidable window/door connecting the lock and connected the lock, to operate the lock to be attached/detached to/from the striker, wherein the striker is laid in the striker holder, not to protrude into the passage space.

Preferably, any one frame rail, except for the outermost frame rails, is processed to be shorter than the other frame rail in length; the striker is stably positioned in the shorter frame rail so as to be at the same level as the other frame rails; and the striker connected to the shorter frame rail is laid in the installation space of the window/door frame, not to protrude into the passage space of the window/door frame.

Preferably, a pair of the frame rails includes connection protrusions to protrude in the window/door frame; the window/door frame under the fixed windows/doors is connected to a stationary cover including a pair of connection hooks positioned under the stationary cover, the connection hooks protruding to be connected to the connection protrusions of the frame rails, so that the fixed windows/doors is stably positioned to be fixed on the stationary cover: the window/door frame under the slidable windows/doors is connected to a rail cover including a pair of connection hooks positioned under the rail cover and rails, the connection hooks protruding to be connected to the connection protrusions of the frame rails and the rails protruding such that rollers installed under lower ends of the slidable windows/doors are stably positioned on the rail cover; and the fixed windows/doors are installed by connecting the connection hooks of the stationary cover to the connection protrusions of the frame rails of the standard window/door frame, the slidable windows/doors are installed by connecting the connection hooks of the rail cover to the connection protrusions of the frame rails, and the fixed windows/doors are changed to the slidable windows/doors in use, vice versa, by only substituting the rail cover for the stationary cover connected to the window/door frame, vice versa, without replacing the window/door frame, in the state that the fixed windows/doors and the slidable windows/doors are installed in the window/door frame.

BRIEF DESCRIPTION OF THE DRAWINGS

The above and other features and advantages of the present invention will become more apparent to those of ordinary skill in the art by describing in detail the preferred embodiments thereof with reference to the attached drawings in which.

[Description of numbers for constituents in drawings]

| | |
|---|---|
| 10: window/door frame | 11: frame rail |
| 12: passage space | 13: installation space |
| 14: middle bar | 20: striker |
| 21: striker holder | 22: finishing cap |
| 23: holder bracket | 24: screw |
| 30: slidable window/door | 31: sash |
| 32: installation channel | 33: glass |
| 34: roller | 35: upper channel |
| 40: lock | 41: lock bracket |
| 50: handle | 60: fixed window/door |
| 70: stationary cover | 71, 81: connection hook |
| 80: rail cover | 82: rail |
| 83, 84: top cover | 85, 86: connection cap |
| 87: clearance groove | 88: cushion member |
| 89: side cover | 90: packing |

DETAILED DESCRIPTION OF THE PREFERRED EMBODIMENT

The present invention will now be described more fully hereinafter with reference to the accompanying drawings, in which the preferred embodiments of the invention are shown so that those of ordinary skill in the art can easily carry out the present invention.

Figure 1:
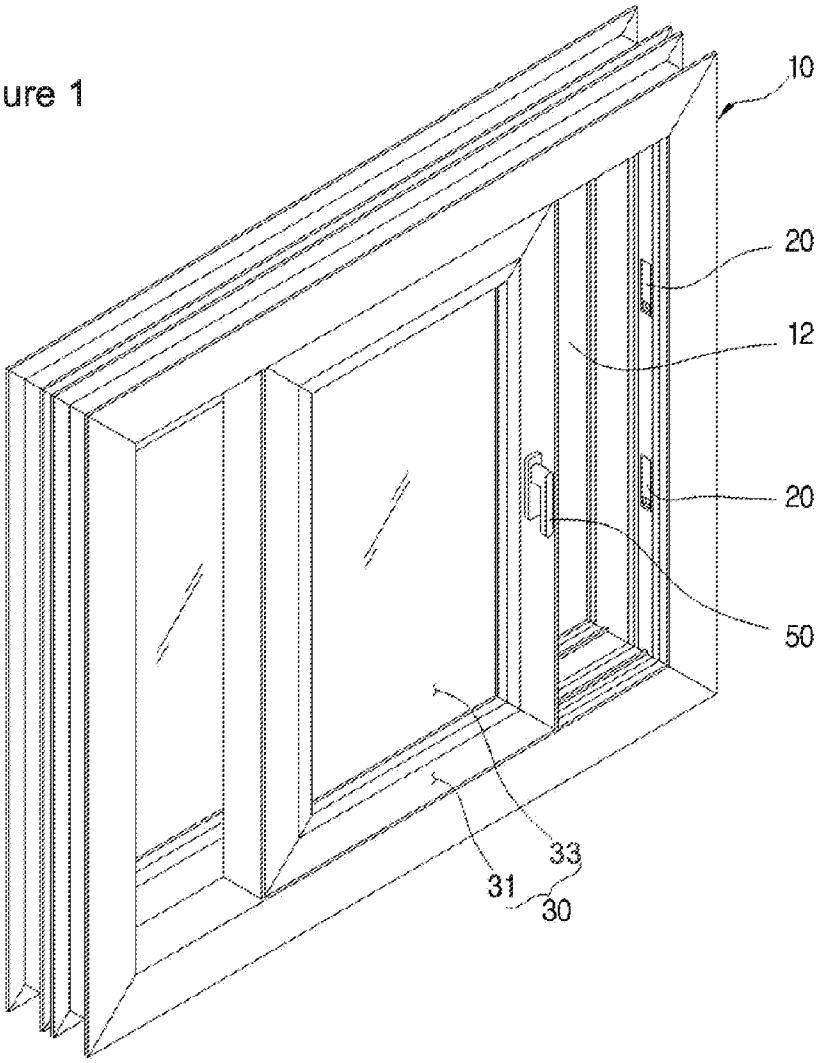
FIG. 1 is a schematic perspective view of a window/door system having an easily changeable structure according to an embodiment of the present invention.
Figure 2:
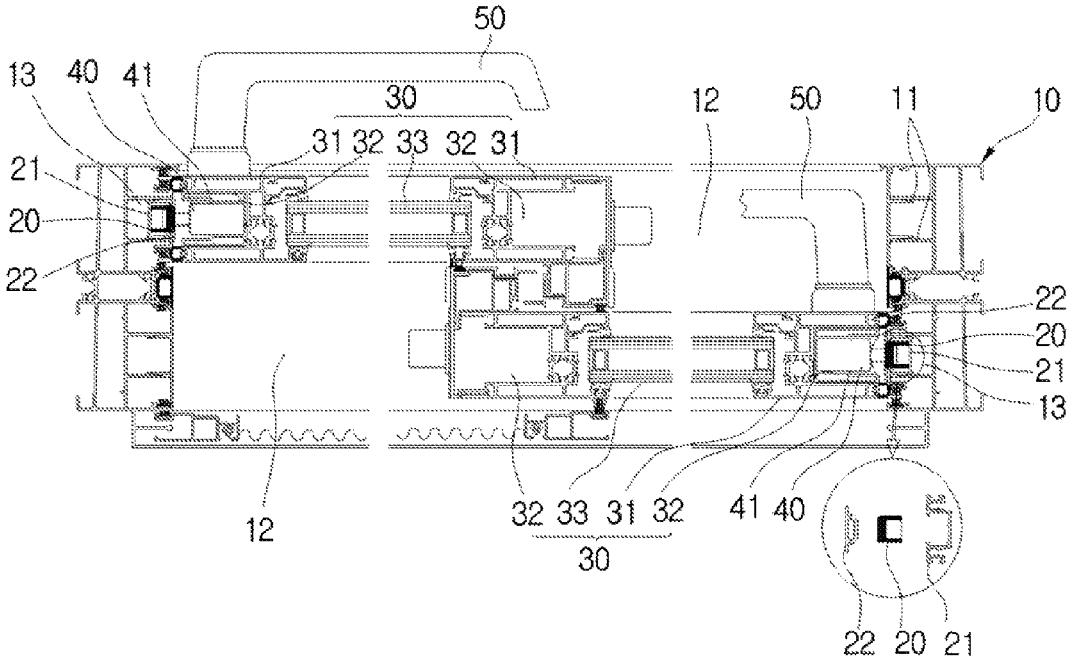
FIG. 2 is a sectional plan view of the window/door system of FIG. 1.

FIG. 1 is a schematic perspective view of a window/door system having an easily changeable structure according to an embodiment of the present invention, and FIG. 2 is a sectional plan view of the window/door system of FIG. 1.

A window/door system having an easily changeable structure according to the present invention comprises: a window/door frame 10, strikers 20, slidable windows/doors 30, locks 40, a handle 50, striker holders 21 and finishing caps 22.

In the window/door frame 10, a passage space 12 is formed, to allow people to enter/exit and to ventilate air. Frame rails 11 of the window/door frame 10 are positioned around the passage space 12, and an installation space 13 is formed between the frame rails 11.

The striker 20 is installed in the installation space 13 on a side jamb of the window/door frame 10. The striker 20 includes a joint hole, to receive an end of the lock 40 to be joined together. Once the slidable window/door 30 to be described later is closed against the window/door frame 10, the end of the lock 40 is engaged in the joint hole such that the lock 40 is joined with the striker 20.

The slidable window/door 30 is installed to slide along the frame rails 11 of the window/door frame 10 and comprises a sash 31 with installation channels 32 formed at its both sides, and a glass 33 installed in the sash 31.

The lock 40 is installed in the installation channel 32 of the sash 31. The lock 40 is attached/detached to/from the striker 20, to attach/detach the slidable window/door 30 to/from the window/door frame 10.

The handle 50 is installed at the sash 31 and is connected to the lock 40. The handle 50 operates the lock 40 to be attached/detached to/from the striker 20.

The striker holder 21 is laid in the installation space 13 on the side jamb of the window/door frame 10. The striker 20 is connected to the striker holder 21 and eventually the striker holder 21 and the striker 20 are laid in the installation space 13 on the side jamb of the window/door frame 10. Therefore, since the striker 20 and the striker holder 21 are laid in the installation space 13 between the frame rails 11 of the window/door frame 10 such that the striker 20 does not protrude into the passage space 12 of the window/door frame 10, the striker 20 is not visible and cannot hit the body of a user when the user passes the passage space 12 of the window/door frame 10.

The finishing cap 22 is connected to the striker holder 21, to support the striker 20 against the striker holder 21.

In this window/door system having an easily changeable structure according to the present invention, the striker 20 are the striker holder 21 are laid in the installation space 13 between the frame rails 11 of the window/door frame 10, so that the striker 20 does not protrude into the passage space 12 of the window/door frame 10. Therefore, since the striker 20 does not protrude into the passage space 12 of the window/door frame 10, when a viewer sees the window/door system from the inside or the outside, the striker 20 is not visible. Accordingly, the nice appearance of the window/door system is maintained.

Further, the striker 20 does not protrude into the passage space 12 of the door frame 10 and therefore, the striker 20 does not contact any part of a user when the user passes the passage space 12 by opening the slidable door 30. As a result, since the striker 20 does not contact any part of the user, any accident is prevented.

Figure 3:
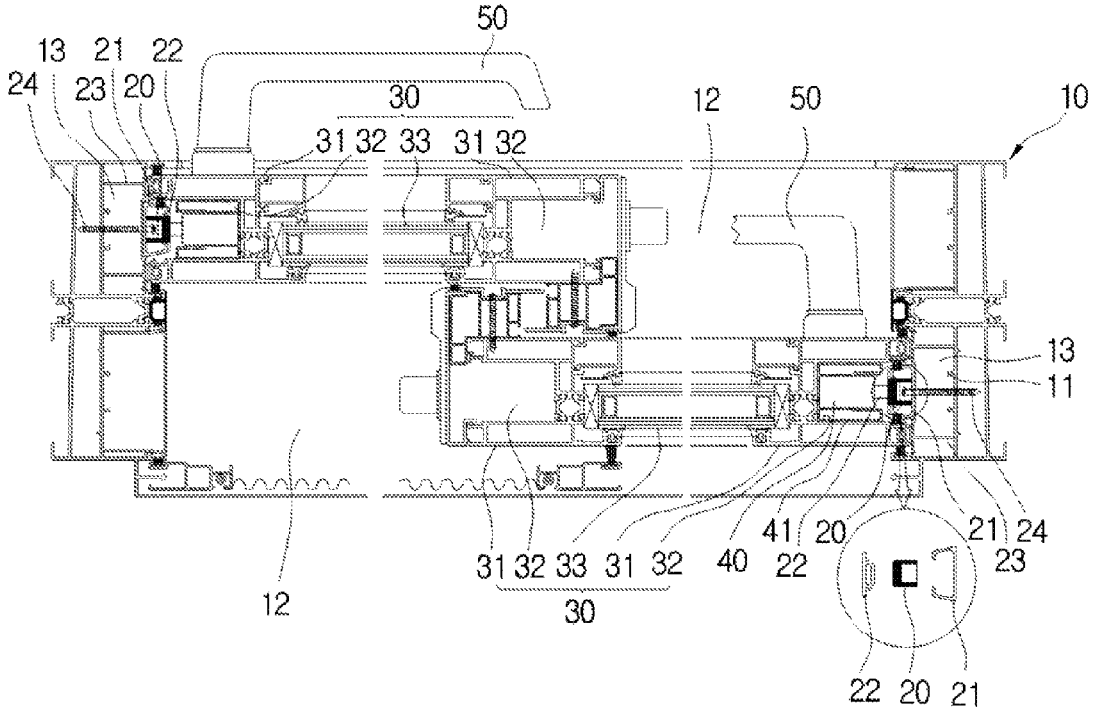
FIG. 3 is a schematic sectional plan view of a modified window/door system of FIG. 2.

FIG. 3 is a schematic sectional plan view of a modified window/door system of FIG. 2.

This window/door system having an easily changeable structure comprises: a window/door frame 10, strikers 20, slidable windows/doors 30, locks 40, a handle 50, holder brackets 23, striker holders 21, screws 24 and finishing caps 22.

In the window/door frame 10, a passage space 12 is formed, to allow people to enter/exit and to ventilate air. An installation space 13 is formed around the passage space 12.

The striker 20 is installed in the installation space 13 on the side jamb of the window/door frame 10.

The slidable window/door 30 is installed to slide along the frame rails 11 of the window/door frame 10 and comprises a sash 31 with installation channels 32 formed at its both sides, and a glass 33 installed in the sash 31.

The lock 40 is installed in the installation channel 32 of the sash 31. The lock 40 is attached/detached to/from the striker 20, to attach/detach the slidable window/door 30 to/from the window/door frame 10.

The handle 50 is installed at the sash 31 and is connected to the lock 40. The handle 50 operates the lock 40 to be attached/detached to/from the striker 20.

The holder bracket 23 is installed in the installation space 13 on the side jamb of the window/door frame 10. The striker 20 is connected to the holder bracket 23 such that the striker 20 is laid in the installation space 13. The striker holder 21 is connected to the holder bracket 23 connected to the striker 20.

The screw 24 connects the striker holder 21, the holder bracket 23 and the window/door frame 10, to secure the striker holder 21 and the holder bracket 23 against the window/door frame 10.

The finishing cap 22 is connected to the striker holder 21, to support the striker 20 against the striker holder 21.

The striker 20, the striker holder 21 and the holder bracket 23 are laid in the installation space 13 on the side jamb of the window/door frame 10, so that the striker 20 does not protrude into the passage space 12 of the window/door frame 10.

In this window/door system having an easily changeable structure according to the present invention, since the striker 20 and the striker holder 21 and the holder bracket 23 are laid in the installation space 13 between the frame rails 11 of the window/door frame 10 as shown in FIG. 2, the striker 20 does not protrude into the passage space 12 of the window/door frame 10. Therefore, since the striker 20 does not protrude into the passage space 12 of the window/door frame 10, when a viewer sees the window/door system from the inside or the outside, the striker 20 is not visible. Accordingly, the nice appearance of the window/door system is maintained. Further, since the striker 20 does not protrude into the passage space 12 of the door frame 10, when a user passes the passage space 12 by opening the slidable door 30, the striker 20 does not contact any part of the user and therefore any accident is prevented.

In this invention, the striker holder 21 is not directly secured to the window/door frame 10 but secured by the holder bracket 23 and the screw 24. Accordingly, when the striker holder 21 cannot be directly connected to the window/door frame 10 since the structure of the window/door frame 10 has been changed, the striker 20 which cannot be directly connected to the window/door frame 10 is secured to the window/door frame 10 by using the holder bracket 23 and the screw 24.

Figure 4:
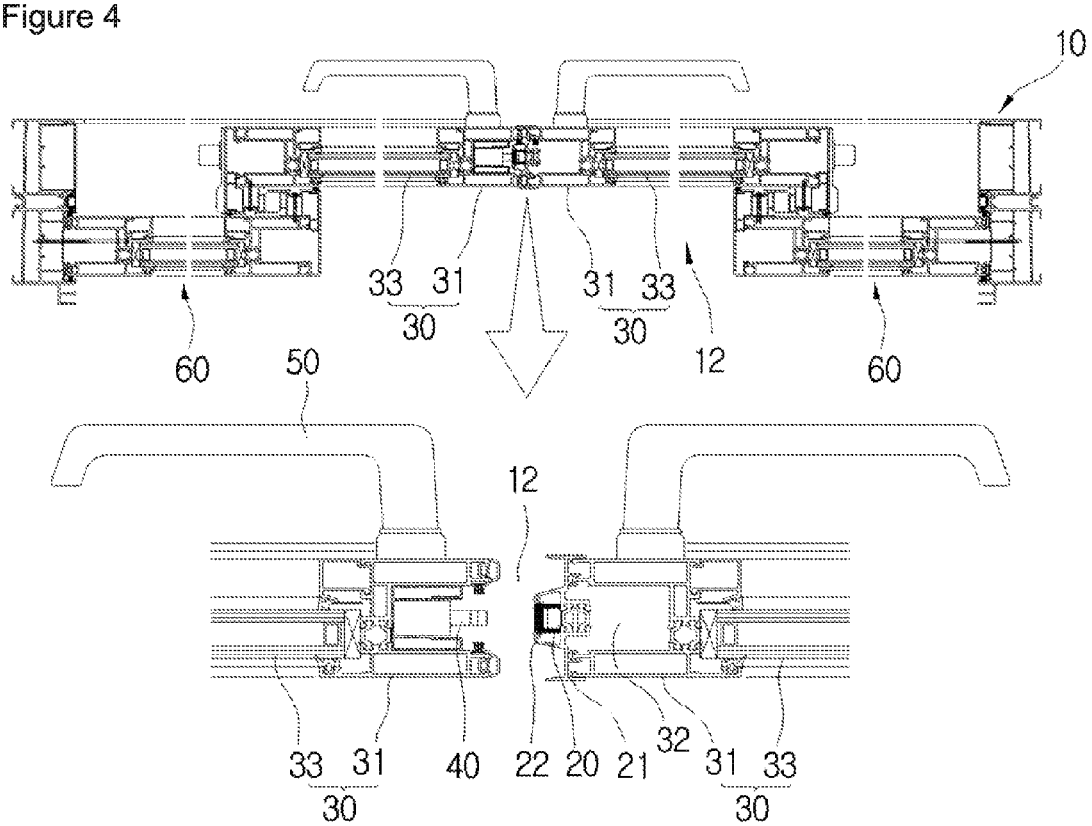
FIG. 4 is a schematic sectional plan view of a window/door system having an easily changeable structure according to a further embodiment of the present invention.

FIG. 4 is a schematic sectional plan view of a window/door system having an easily changeable structure according to a further embodiment of the present invention.

In this window/door system having an easily changeable structure, a window/door frame 10 includes with a passage space 12 formed to allow people to enter/exit and to ventilate air. A pair of fixed windows/doors 60 is installed at both side jambs of the window/door frame 10, to be fixed to the window/door frame 10.

A pair of slidable windows/doors 30 is installed to slide in the window/door frame 10. These windows/doors 30 open/close the passage space 12 between the fixed windows/doors 60. Each slidable window/door 30 comprises a sash 31 with installation channels 32 formed at its both sides, and a glass 33 installed in the sash 31.

A striker holder 21 is connected to the sash 31 of any one of the slidable windows/doors 30. A striker 20 is connected to the striker holder 21. The striker 20 is installed in the striker holder 21 such that the striker 20 does not protrude into the passage space 12. A finishing cap 22 is connected to the striker holder 21 so that the striker 20 is supported to the striker holder 21.

A lock 40 is installed in the installation channel 32 of the other slidable window/door 30. The lock 40 is attached/detached to/from the striker 20, to attach/detach one slidable window/door 30 to/from the other slidable window/door 30.

A handle 50 is installed at the slidable window/door 30 where the lock 40 is installed. The handle 50 is connected to the lock 40, to operate the lock 40 to be attached/detached to/from the striker 20.

In this window/door system having an easily changeable structure, the striker 20 is laid in the striker holder 21 such that the striker 20 does not protrude into the passage space 12 of the window/door frame 10. Therefore, since the striker 20 does not protrude into the passage space 12 of the window/door frame 10 when a viewer sees the window/door system from the inside or the outside, the striker 20 is not visible. Accordingly, the nice appearance of the window/door system is maintained.

Further, since the striker 20 does not protrude into the passage space 12 of the door frame 10, the striker 20 does not contact any part of a user when (s)he passes the passage space 12 by opening the slidable door 30, preventing any accident.

In this window/door system, since the striker 20 is installed in one slidable window/door 30 and separately the lock 40 is installed in the slidable window/door 30, if the two slidable windows/doors 30 are dosed, the lock 40 is locked into the striker 20. If an end of the lock 40 is separated from the striker 20 by pulling the handle 50, the pair of the slidable windows/doors 30 is freely opened.

In this window/door system, the striker 20 is installed to be enclosed in the striker holder 21 such that it is not visible, the nice appearance of the window/door system is not damaged and any accident is prevented.

Figure 5:
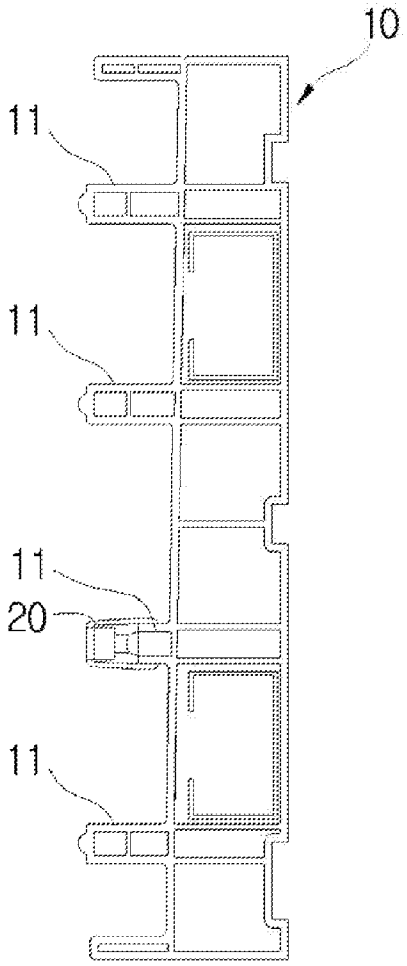
FIG. 5 is a schematic and partial sectional plan view of a window/door system having an easily changeable structure according to a further embodiment of the present invention.

FIG. 5 is a schematic and partial sectional plan view of a window/door system having an easily changeable structure according to a further embodiment of the present invention.

In this window/door system, any one frame rail 11, except for the outermost frame rails 11 among the frame rails 11 of a window/door frame 10, is formed to be shorter than the length of the other frame rail 11. A striker 20 is connected to the short-length frame rail 11. The striker 20 connected to the short-length frame rail 11 is laid in an installation space 13 of the window/door frame 10 and therefore it does not protrude into a passage space 12 of the window/door frame 10.

Accordingly, in this window/door system, since one of the frame rails 11 is cut to be shorter and the striker 20 is inserted in the shorter frame rail 11 to be connected together, any additional striker holder is not needed and therefore the number of parts decreases, reducing the number of assemblers and the manufacturing cost.

Figure 6:
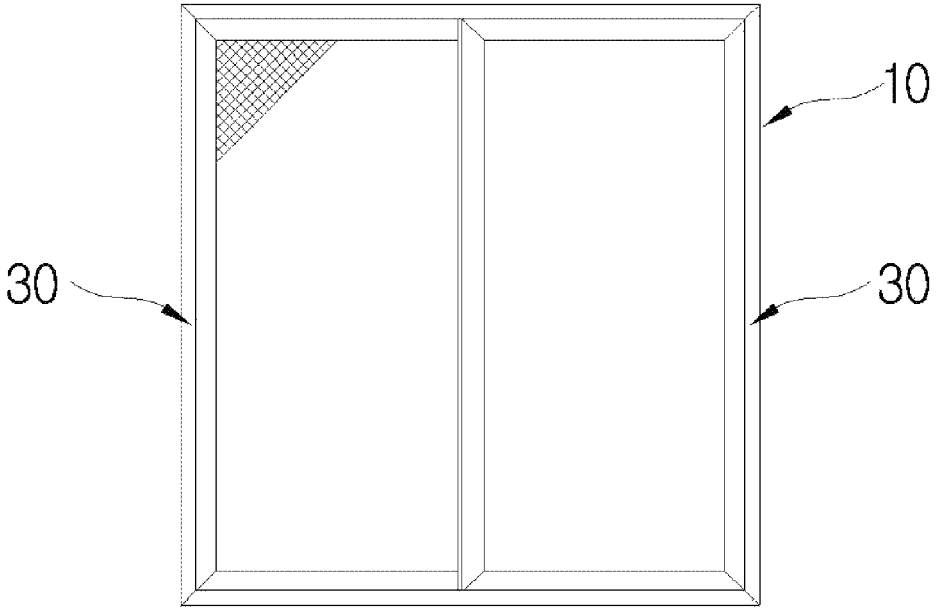
FIG. 6 is a schematic front view of the window/door system according to a further embodiment of the present invention.
Figure 7:
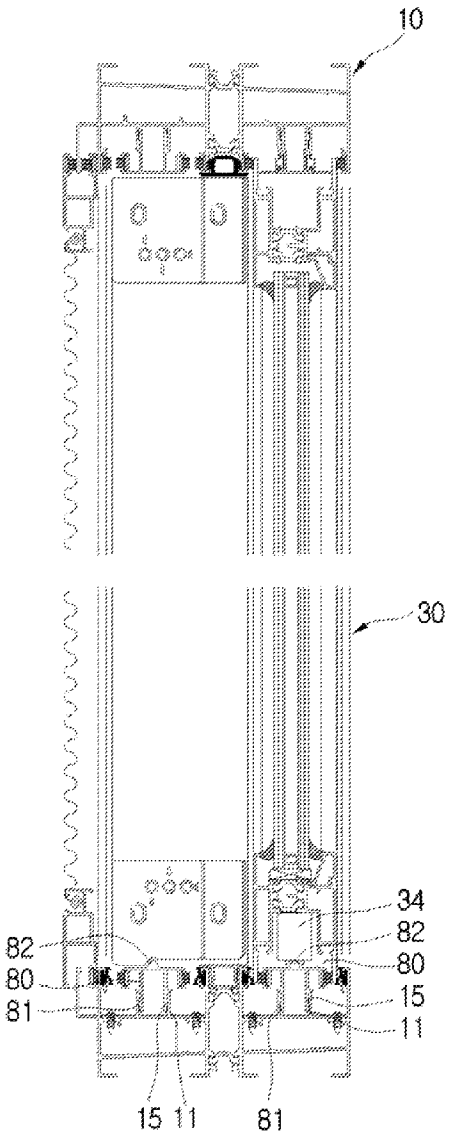
FIG. 7 is a schematic sectional side view of the window/door system of FIG. 6.
Figure 8:
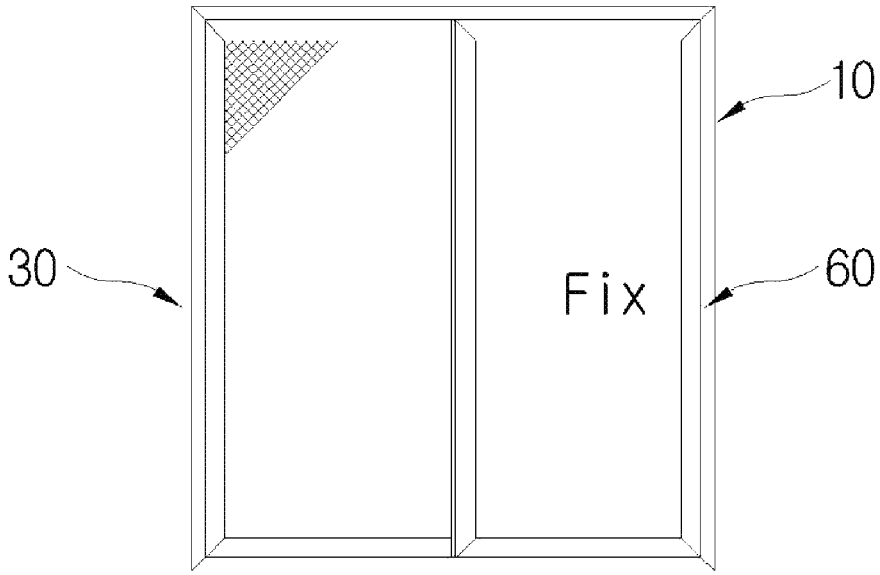
FIG. 8 is a schematic front view of the window/door system of FIG. 6 wherein the structure has been changed.
Figure 9:
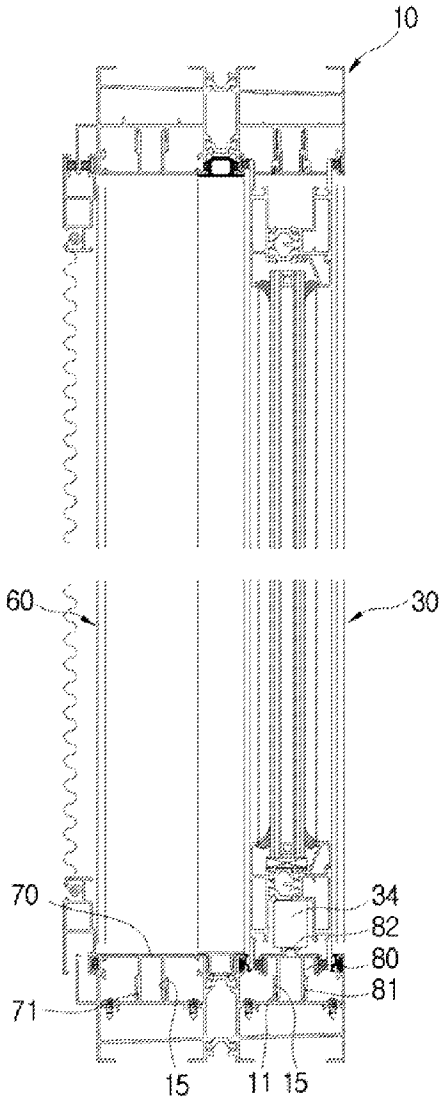
FIG. 9 is a schematic sectional side view of the window/door system of FIG. 8.

FIG. 6 is a schematic front view of a window/door system having an easily changeable structure according to a further embodiment of the present invention, FIG. 7 is a schematic sectional side view of the window/door system of FIG. 6, FIG. 8 is a schematic front view of the window/door system of FIG. 6 wherein the structure has been changed, and FIG. 9 is a schematic sectional side view of the window/door system of FIG. 8.

In this window door system having an easily changeable structure, a pair of frame rails 11 with connection protrusions 15 protrudes upward from a window/door frame 10. A stationary cover 70 is provided in the window/door frame 10 under a fixed window/door 60 such that the stationary cover 70 is connected to the connection protrusions 15 of the frame rails 11. The stationary cover 70 includes a pair of connection hooks 71 protruding to be connected to the connection protrusions 15 of the frame rails 11. The fixed window/door 60 is stably positioned and fixed on the stationary cover 70.

A rail cover 80 is provided in the window/door frame 10 under a slidable window/door 30, to be connected to the connection protrusions 15 of the frame rails 11. The rail cover 80 includes a pair of connection hooks 81 protruding to be connected to the connection protrusions 15 of the frame rails 11. A rail 82 protrudes on the rail cover 80 such that a roller 34 installed under a lower end of the slidable window/door 30 is stably held.

This window/door system is characterized in that the fixed window/door 60 is installed by connecting the connection hooks 71 of the stationary cover 70 to the connection protrusions 15 of the frame rails 11 of the standard window/door frame 10 or the slidable window/door 30 is installed by connecting the connection hooks 81 of the rail cover 80 to the connection protrusions 15 of the rails 11.

Accordingly, when the fixed window/door 60 needs to be the slidable window/door 30 or the slidable window/door 30 needs to be the fixed window/door 60 in the state that the fixed window/door 60 and the slidable window/door 30 are installed in the window/door frame 10, it is possible change the use of the window/door by only substituting the rail cover 80 for the stationary cover 70 or substituting the stationary cover 70 for the rail cover 80 connected to the window/door frame 10, without changing the window/door frame 10.

In the present invention, it is possible to install the fixed window/door 60 by connecting the connection hooks 71 of the stationary cover 70 to the connection protrusions 15 of the frame rails 11 of the standard window/door frame or to install the slidable window/door 30 by connecting the connection hooks 81 of the rail cover 80 to the connection protrusions 15 of the frame rails 11. In the state that the fixed window/door 60 and the slidable window/door 30 are installed in the window/door frame 10, it is possible to change the use of the window/door, from the fixed window/door 60 to the slidable window/door 30, vice versa (form the slidable window/door 30 to the fixed window/door 60), by only substituting the rail cover 80 for the stationary cover 70 connected to the window/door frame 10, without changing the window/door frame 10, vice versa (the stationary cover 70 for the rail cover 80).

That is, as shown in FIG. 6 and FIG. 7, in order to use any one of a pair of the slidable windows/doors 30 as the fixed window/door 60 in the state that the slidable windows/doors 30 are installed in the window/door frame 10, the one slidable window/door 30 to be changed as the fixed window/door 60 in use is separated from the window/door frame 10, to expose the rail cover 80. The exposed rail cover 80 is separated from the frame rails 11 of the window/door frame 10.

As shown in FIG. 9, the stationary cover 70 is connected to the frame rails 11 of the window/door frame 10 after the rail cover 80 is separated. The fixed window/door 60 is positioned on the stationary cover 70, to be fixed by using silicon or a screw. After the fixed window/door is glazed, silicon or a strip (Osai) is used to secure the glass in the fixed window/door 60.

In this window/door system, since the fixed window/door 60 is changed to the slidable window/door 30, vice versa, by the very simple work of substituting the rail cover 80 for the stationary cover 70 in the window/door frame 10, vice versa; the structure change is very easy.

Accordingly, the structural changes of the window/door systems in various shapes are realized with the three (3) kinds of components, the standard window/door frame 10, the stationary cover 70 and the rail cover 80. Also, since the structure of the window/door system which has been already built can be easily changed, compatibility, constructability and mass-productivity are greatly improved.

Figure 10:
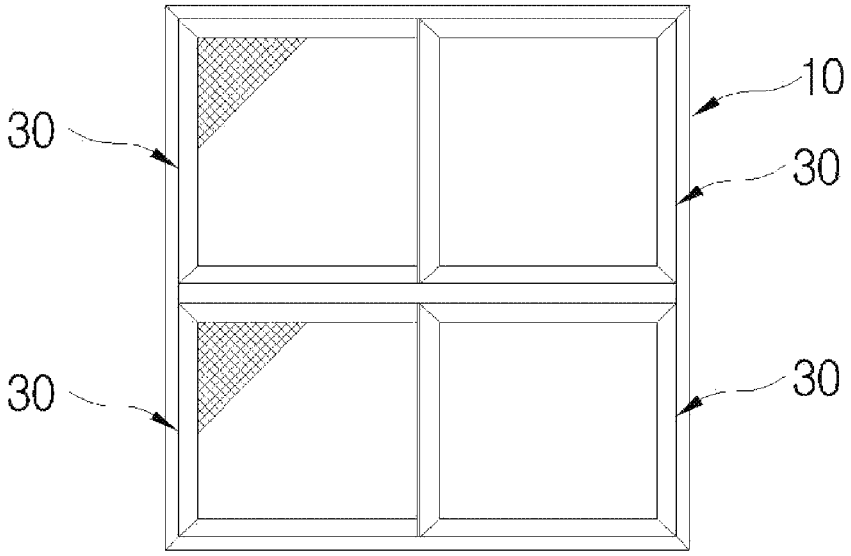
FIG. 10 is a schematic front view of the window/door system according to a further embodiment of the present invention.
Figure 11:
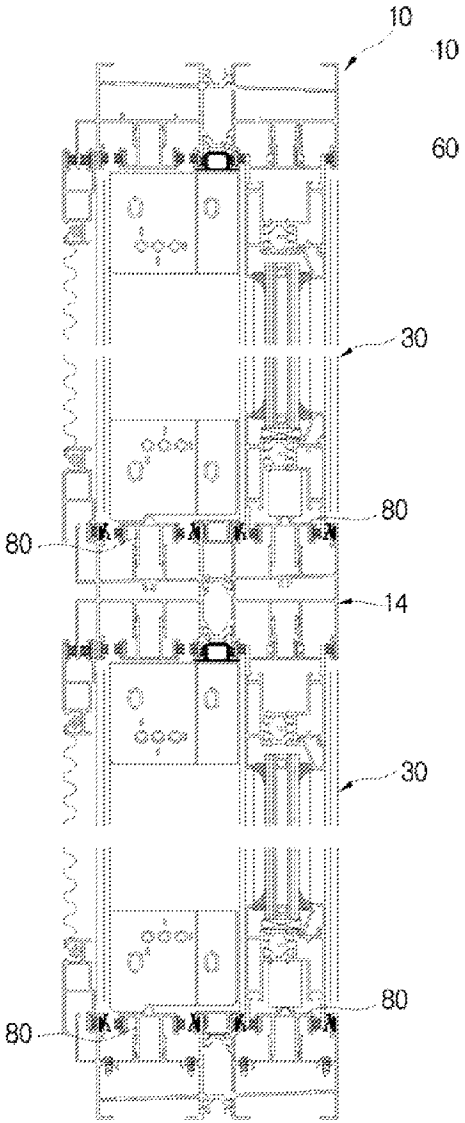
FIG. 11 is a schematic sectional side view of the window/door system of FIG. 10.
Figure 12:
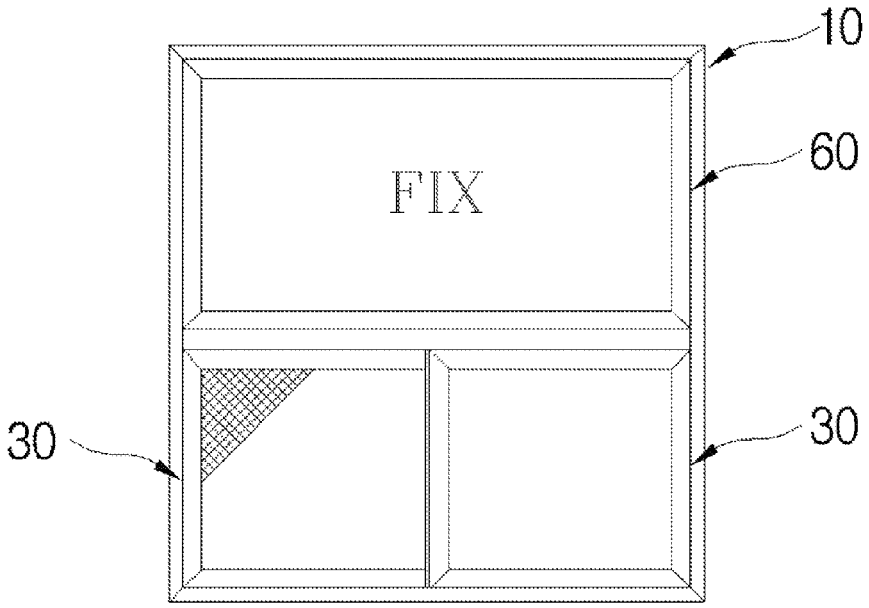
FIG. 12 is a schematic front view of the window/door system of FIG. 10 wherein the structure has been changed.
Figure 13:
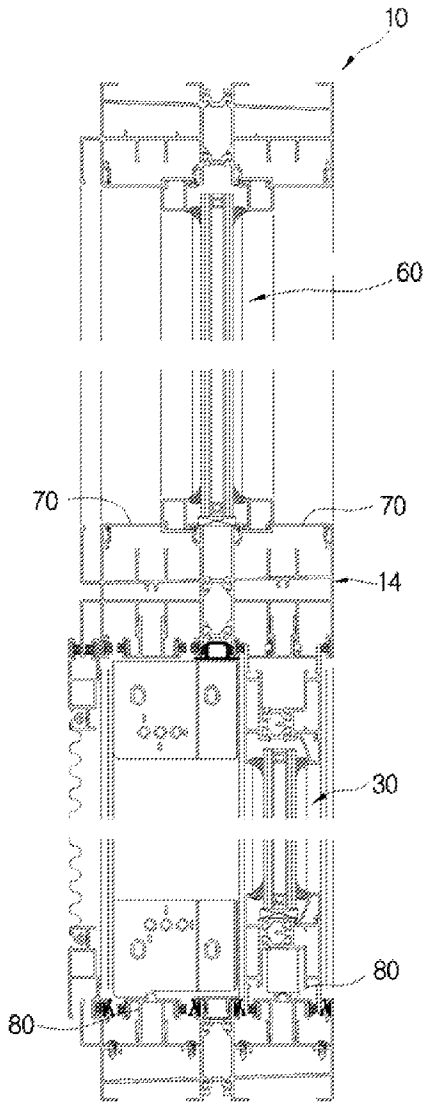
FIG. 13 is a schematic sectional side view of the window/door system of FIG. 12.

FIG. 10 is a schematic front view of a window/door system having an easily changeable structure according to a further embodiment of the present invention, FIG. 11 is a schematic sectional side view of the window/door system of FIG. 10, FIG. 12 is a schematic front view of the window/door system of FIG. 10 wherein the structure has been changed, and FIG. 13 is a schematic sectional side view of the window/door system of FIG. 12.

In this window/door system, a middle bar 14 is further installed horizontally in the middle of a window/door frame 10 such that the window/door frame 10 has an upper space and a lower space. As shown in FIG. 10 and FIG. 11, a pair of upper slidable windows/doors 30 is installed in the upper space and a pair of lower slidable windows/doors 30 is installed in the lower space.

To change the upper slidable windows/doors 30 to a fixed window/door 60 by changing the structure of this window/door system, the upper slidable windows/doors 30 are separated from the window/door frame 10, rail covers 80 connected on the middle bar 14 are separated from the middle bar 14, stationary covers 70 are connected on the middle bar 14 from which the rail covers 80 are separated.

After the fixed window/door 60 is connected to the stationary covers 70, silicon is applied to a joint area and a strip (Osai) is inserted into around the fixed window/door 60 to be finished. In this manner, the upper slidable windows/doors 30 can be easily changed to the fixed window/door 60 in the upper space of the window/door frame 10.

Figure 14:
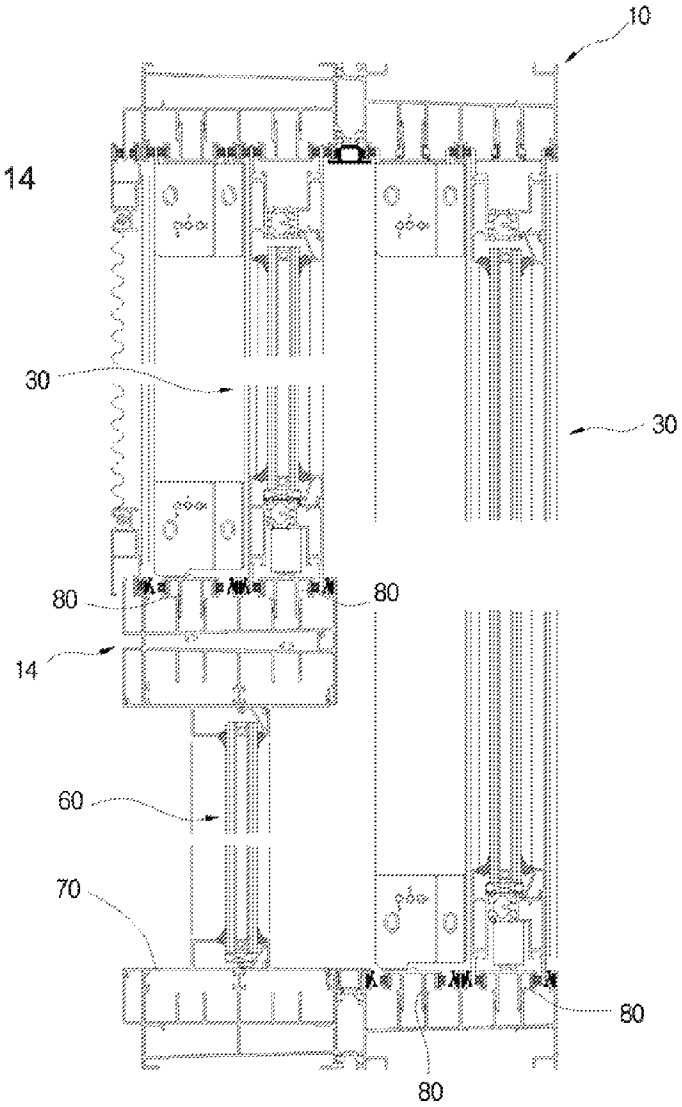
FIG. 14 is a schematic sectional side view of the window/door system according to a further embodiment of the present invention, wherein the structure has been changed.

FIG. 14 is a schematic sectional side view of a window system having an easily changeable structure according to a further embodiment of the present invention, wherein the structure has been changed. In this window system, rail covers 80 are connected to a window frame 10 for an interior window. A pair of slidable windows 30 each having a single pane of glass is installed in the rail covers 80.

A middle bar 14 is further installed horizontally in the middle of a window frame 10 for an exterior window. The exterior window is divided into an upper space and a lower space. A pair of slidable windows 30 is installed in the upper space and a fixed window 60 is installed in the lower space. The fixed window 60 is fixed at a lower position for the exterior window, to function as a guard rail to prevent any accident.

To change the slidable windows 30 installed in the upper space for the exterior window to the fixed window(s) 60 by changing the structure of the window system according to the present invention, the slidable windows 30 installed in the upper space are separated from the window frame 10, the rail covers 80 connected on the middle bar 14 are separated from the middle bar 14, stationary covers 70 are connected on the middle bar 14 from which the rail covers 80 are separated.

After the fixed window(s) 60 is connected to the stationary covers 70, silicon is applied to a joint area and/or a strip (Osai) is inserted into around the fixed window(s) 60 to be finished. In this manner, the slidable windows 30 installed in the upper space of the window frame 10 for the exterior window is easily changed to the fixed window(s) 60.

Figure 15:
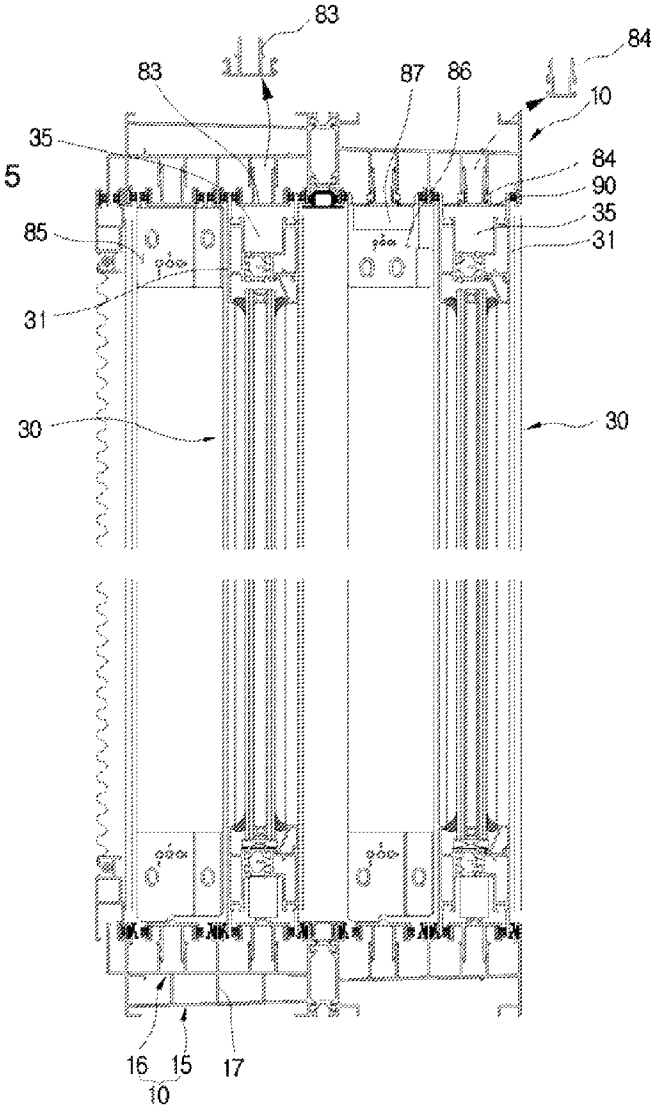
FIG. 15 is a schematic sectional side view of a window/door system according to a further embodiment of the present invention.
Figure 16:
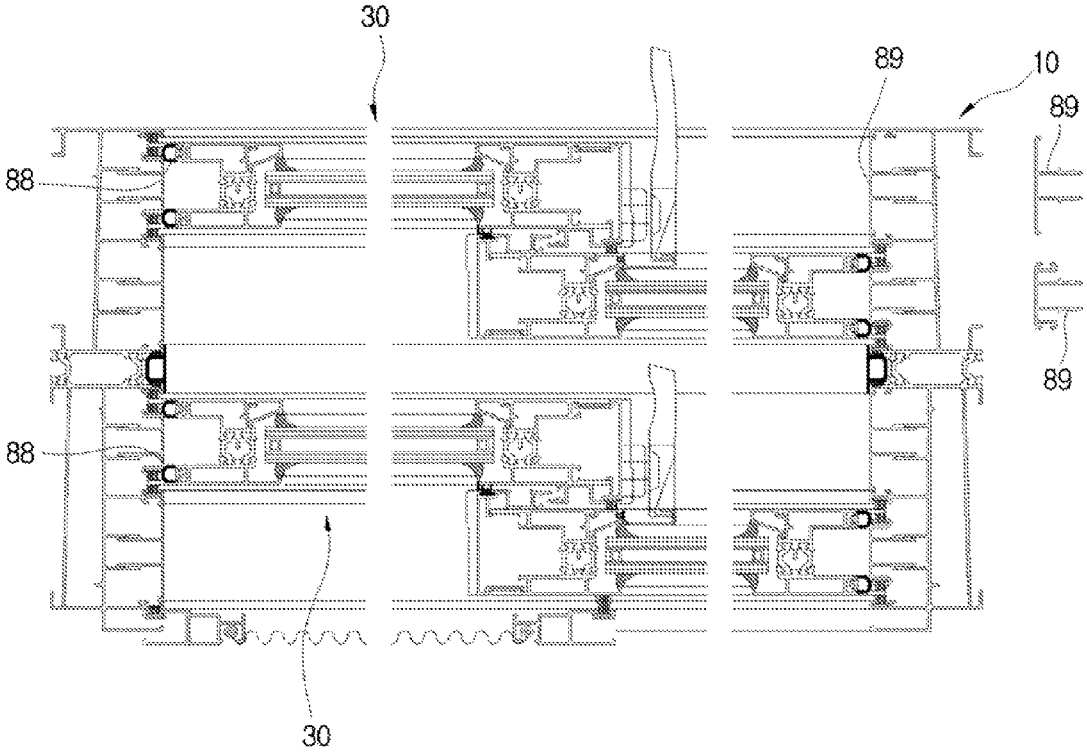
FIG. 16 is a sectional top view of the window/door system of FIG. 15.

FIG. 15 is a schematic sectional side view of a window/door system according to a further embodiment of the present invention, and FIG. 16 is a sectional top view of the window/door system of FIG. 15.

In this window/door system, top covers 83 are connected to an exterior window/door inside a window/door frame 10. The top cover 83 has a greater width than the horizontal width of an upper channel 35 formed in an upper position of a sash 31 of a slidable window/door 30. When the slidable window/door 30 for the exterior window/door is lifted upward, the top ends of the sash 31 are stopped by the bottom of the top cover 83, so that the slidable window/door 30 for the exterior window/door is prevented from accidentally leaving the window/door frame 10.

In the sash 31 of the slidable window/door 30 for the exterior window/door, a connection cap 85 is further connected to finish both ends of the sash 31. In addition, when the slidable window/door 30 for the exterior window/door is lifted upward, both ends of the sash 31 hit the bottom of the top cover 83 and therefore the slidable window/door 30 for the exterior window/door is prevented from accidentally leaving the window/door frame 10, thereby preventing any damage by a falling window/door.

Top covers 84 are connected to an interior window/door inside the window/door frame 10. The top cover 84 has a smaller width than the horizontal width of the upper channel 35 formed in an upper position of a sash 31 of a slidable window/door 30. When the slidable window/door 30 for the interior window/door is lifted upward, the top cover 84 enters the upper channel 35 of the sash 31 and the slidable window/door 30 for the interior window/door leaves the window/door frame 10. When the slidable window/door 30 for the interior window/door is lifted upward, the top ends of the sash 31 rises by pushing up packing 90 connected to both sides of the top cover 84 and the upper channel 35 of the sash 31 is positioned around the top cover 84.

In the sash 31 of the slidable window/door 30 for the interior window/door, a connection cap 86 having a clearance groove 87 is further connected to finish both ends of the sash 31. In addition, when the slidable window/door 30 for the interior window/door is lifted upward, the top cover 84 enters the clearance groove 87 and therefore the slidable window/door 30 for the interior window/door enables removal from the window/door frame 10.

In the structure of this window/door system, since the slidable window/door 30 for the interior window/door is freely attached/detached but the slidable window/door 30 for the exterior window/door is not attached/detached, to prevent any accident that the slidable window/door 30 falls outside or people inside fall out of the window/door.

Further, it prevents a noise occurring when the slidable window/door 30 contacts the window/door frame 10. A cushion member 88 is connected to one side of the slidable window/door 30, to improve airtightness and soundproofing in the state that the slidable window/door 30 is closed against the window/door frame 10.

Further, side covers 89 are connected to both side jambs inside the window/door frame 10. The side cover 89 has a flat outer surface to prevent any protrusions or grooves from being shown at the both side jambs of the window/door frame 10. Therefore, since no protrusions or grooves are shown at the both side jambs of the window/door frame 10, the appearance of the window/door system is nice and the problem of the conventional window/door system in that foreign materials collect in the grooves or between the protrusions is prevented.

In this window/door system, a lower section of the window/door frame 10 includes a rail support 16 to be attached/detached to/from a frame 15 and the inside of the frame 15. The rail support 16 is attached/detached to/from the frame 15, to clean the foreign materials collecting inside the window/door frame 10.

A partition 17 is positioned under the rail support 16, to improve water-tightness, air-tightness and soundproofing by dividing the space between the frame 15 and the rail support 16. The partition 17 may be one only as shown in FIG. 15, but it may be formed in two or more. In such a case, since the space between the frame 15 and the rail support 16 is divided into a plurality of compartments, the water-tightness, air-tightness and soundproofing are further improved.

The frame 15 and the rail support 16 may be connected by using a screw or in one-touch manner by forming a locking hook or locking groove in the frame 15 and forming a locking groove or a locking hook in the rail support 16.

In the present invention as described above, the striker and the striker holder is laid or positioned in the installation space between the frame rails of the window/door frame. Therefore, since the striker does not protrude into the passage space of the window/door frame, the nice appearance of the window/door system is maintained. Also, when a user passes the passage space of the door frame, since the striker does not contact any part of the user, any accident is prevented.

According to the present invention, the fixed window/door is installed by connecting the connection hooks of the stationary cover to the connection protrusions of the frame rails of the standardized window/door frame, and the slidable window/door is installed by connecting the connection hooks of the rail cover to the connection protrusions of the frame rails. The fixed window/door is able to be changed to the slidable window/door in use, vice versa, by only substituting the rail cover for the stationary cover connected to the window/door frame, vice versa, without replacing the window/door frame, in the state that the fixed window/door and the slidable window/door are installed in the window/door frame. Therefore, since the window/door system according to the present invention is capable of changing the fixed window/door to the slidable window/door, vice versa, by the very simple work of substituting the rail cover for the stationary cover, vice versa, in the window/door frame, the structural change is very easy. Therefore, since the window/door systems in various shapes are realized with only three (3) kinds of components, the standard window/door frame, stationary cover and rail cover and the window/door system which has been already built is able to be easily changed in structure, the compatibility, constructability and mass-productivity are greatly improved.

The invention has been described using preferred exemplary embodiments. However, it is to be understood that the scope of the invention is not limited to the disclosed embodiments. On the contrary, the scope of the invention is intended to include various modifications and alternative arrangements within the capabilities of persons skilled in the art using presently known or future technologies and equivalents. The scope of the claims, therefore, should be accorded the broadest interpretation so as to encompass all such modifications and similar arrangements.

What is claimed is:

1. A system for one of a door and widow having a retrofit structure comprising:

a frame (10) for one of a door and widow having frame rails (11) positioned around a passage space (12), and an installation spaces (13) formed between the frame rails (11);

a striker (20) to be installed in the installation space (13) on a side jamb of the frame (10);

a slidable member (30) installed to slide along the flame rails (11), the slidable member (30) including a sash (31) with installation channels (32) formed on a first external side of the slidable member proximal the side jamb and on a second external side of the slidable member opposite the first external side and a glass (33) installed in the sash (31);

a lock (40) installed in the installation channel (32) of the sash (31) proximal the side jamb, to be reversibly attached to the striker (20) to reversibly attach the slidable member (30) to the frame (10);

a handle (50) installed in the sash (31) and connected to the lock (40), to operate the locks (40) to be reversibly attached to the striker (20);

a striker holder (21) connected to the striker (20) to be laid in the installation space (13) on the side jamb of the frame (10); and a finishing cap (22) connected to the striker holder (21), to support the striker (20) in the striker holder (21), wherein the striker (20) and the striker holder (21) are laid in the installation space (13) between the frame rails (11), so as not to protrude into the passage space (12) of the frame (10).

2. The system according to claim 1, wherein any one of the frame rails (11), except for outermost frame rails (11) of the frame rails (11), is processed to be shorter in height than other frame rails of the frame rails (11);

the striker (20) is irremovably coupled to the shorter frame rail and positioned in the shorter frame rail (11) so as to be at a level of equal height as the other frame rails (11); and the striker (20) connected to the shorter frame rail (11) is laid in the installation space (13) of the frame (10), so as not to protrude into the passage space (12) of the frame (10).

3. The system according to claim 1, further comprising:

top covers (83), each of the top covers connected on an exterior partition selected from one of a window and a door, said exterior partition positioned inside the frame (10), wherein each top cover (83) has a greater width than the horizontal width of an upper channel (35) formed in an upper position of the sash (31) of the slidable member (30), wherein, when the slidable member (30) for the exterior partition is lifted in an upwards direction, top ends of the sash (31) are stopped under a bottom edge of the top cover (83) and therefore the slidable member (30) for the exterior partition is prevented from leaving the frame (10), so as to improve air-tightness, water-tightness, outside wind pressure-resistance and soundproofing;

top covers (84) each connected on an interior partition inside the frame (10), wherein each top cover (84) has a shorter width than a horizontal width of an upper channel (35) formed in an upper position of the sash (31) of the slidable member (30), wherein, when the slidable member (30) for the interior partition is lifted in the upwards direction, the top cover (84) enters the upper channel (35) of the sash (31) and the slidable member (30) for the interior partition is removed the frame (10);

a cushion member (88) connected to one side of the slidable member (30), to prevent a noise occurring when the slidable member (30) contacts the frame (10) and to improve the air tightness and soundproofing in a state that the slidable member (30) is closed against the frame (10); and side covers (89) each having a flat outer surface connected to both side jambs inside the frame (10), to prevent any protrusions or grooves from being shown at both the side jambs of the frame (10).

4. The system according to claim 3, further comprising:

a rail support (16) provided under the frame (10), to be reversibly attached to a frame element (15) and an inside of the frame (15), the rail support (16) provided to be reversibly attached to the frame element (15), to clean foreign materials collecting inside the frame (10); and one or more partitions (17) positioned under the rail support (16), to improve the water-tightness, air-tightness and soundproofing by dividing a space between the frame element (15) and the rail support (16).

5. A system for one of a door and widow having a retrofit structure comprising:

a frame (10) for one of a door and widow with an installation spaces (13) formed around a passage space (12);

a striker (20) to be installed in the installation space (13) on a side jamb of the frame (10);

a slidable member (30) installed to slide along frame rails (11), including a sash (31) with installation channels (32) formed on a first external side of the slidable member proximal the side jamb and on a second external side of the slidable member opposite the first external side and a glass (33) installed in the sash (31);

a lock (40) installed in the installation channel (32) of the sash (31) proximal the side jamb, to be reversibly attached to the striker (20) to reversibly attach the slidable member (30) to the frame (10);

a handle (50) installed in the sash (31) and connected to the lock (40), to operate the lock (40) to be reversibly attached to the striker (20);

a holder bracket (23) connected to the striker (20) to be laid in the installation space (13) on the side jamb of the frame (10);

a striker holder (21) connected to the holder bracket (23), to connect to the striker (20);

a screw (24) connected through the striker holder (21), the holder bracket (23) and the frame (10); and a finishing cap (22) connected to the striker holder (21), to support the striker (20) in the striker holder (21), wherein the striker (20), the striker holder (21) and the holder bracket (23) are laid in the installation space (13) on the side jamb of the frame (10), snot to protrude into the passage space (12) of the frame (10).

6. The system according to claim 5, further comprising:

top covers (83), each of the top covers connected on an exterior partition selected from one of a window and a door, said exterior partition positioned inside the frame (10), wherein each top cover (83) has a greater width than the horizontal width of an upper channel (35) formed in an upper position of the sash (31) of the slidable member (30), wherein, when the slidable member (30) for the exterior partition is lifted in an upwards direction, top ends of the sash (31) are stopped under a bottom edge of the top cover (83) and therefore the slidable member (30) for the exterior partition is prevented from leaving the frame (10), so as to improve air-tightness, water-tightness, outside wind pressure-resistance and soundproofing;

top covers (84) each connected on an interior partition inside the frame (10), wherein each top cover (84) has a shorter width than a horizontal width of an upper channel (35) formed in an upper position of the sash (31) of the slidable member (30), wherein, when the slidable member (30) for the interior partition is lifted in the upwards direction, the top cover (84) enters the upper channel (35) of the sash (31) and the slidable member (30) for the interior partition is removed the frame (10);

a cushion member (88) connected to one side of the slidable member (30), to prevent a noise occurring when the slidable member (30) contacts the frame (10) and to improve the air tightness and soundproofing in a state that the slidable member (30) is closed against the frame (10); and side covers (89) each having a flat outer surface connected to both side jambs inside the frame (10), to prevent any protrusions or grooves from being shown at both the side jambs of the frame (10).

7. A system for one of a door and widow having a retrofit structure comprising:

a frame (10) for one of a door and widow providing a passage space (12);

a pair of fixed partitions (60) installed to be fixed to either side jamb of the frame (10);

a pair of slidable members (30) installed to slide in the frame (10), to reversibly open the passage space (12) between the slidable members (30), each of the slidable members (30) including a sash (31) with installation channels (32) formed on a first external side of the slidable member proximal the side jamb and on a second external side of the slidable member opposite the first external side and a glass (33) installed in the sash (31);

a striker holder (21) connected to the sash (31) of a first of the slidable members (30);

a striker (20) connected to an inside of the striker holder (21);

a finishing cap (22) connected to the striker holder (21), to support the striker (20) in the striker holder (21);

a lock (40) installed in the installation channel (32) of a second of the slidable members (30), to be reversibly attached to the striker (20) to reversibly attach the second slidable member (30) to the first slidable member (30); and a handle (50) installed in the second slidable member (30), to operate the lock (40) to be reversibly attached to the striker (20), wherein the striker (20) is laid in the striker holder (21), so as not to protrude into the passage space (12).

8. The system according to claim 7, further comprising:

connection protrusions (15) to protrude in the frame (10) formed in a pair of frame rails (11);

a stationary cover (70) with a pair of connection hooks (71) positioned under the stationary cover (70) connected to the frame (10) under the fixed partitions (60), the connection books (71) protruding to be connected to the connection protrusions (15) of the frame rails (11) such that the fixed partitions (60) are positioned to be fixed on the stationary cover (70); and a rail cover (80) with a pair of connection hooks (81) positioned under the rail cover (80) and rails (82) connected to the frame (10) under the slidable members (30), the connection hooks (81) protruding to be connected to the connection protrusions (15) of the frame rails (11) and the rails (82) protruding such that rollers (34) installed under lower ends of the slidable members (30) are positioned on the rail cover (80);

wherein the fixed partitions (60) are installed by connecting the connection hooks (71) of the stationary cover (70) to the connection protrusions (15) of the frame rails (11) of the frame (10), the slidable members (30) are installed by connecting the connection hooks (81) of the rail cover (80) to the connection protrusions (15) of the frame rails (11), and wherein the fixed partitions (60) are changeable with the slidable members (30) in use, by only substituting the rail cover (80) for the stationary cover (70) connected to the frame (10), without replacing the frame (10), in a state that the fixed partitions (60) and the slidable members (30) are installed in the frame (10).

9. The system according to claim 7, further comprising:

top covers (83), each of the top covers connected on an exterior partition selected from one of a window and a door, said exterior partition positioned inside the frame (10), wherein each top cover (83) has a greater width than the horizontal width of an upper channel (35) formed in an upper position of the sash (31) of the slidable member (30), wherein, when the slidable member (30) for the exterior partition is lifted in an upwards direction, top ends of the sash (31) are stopped under a bottom edge of the top cover (83) and therefore the slidable member (30) for the exterior partition is prevented from leaving the frame (10), so as to improve air-tightness, water-tightness, outside wind pressure-resistance and soundproofing;

top covers (84) each connected on an interior partition inside the frame (10), wherein each top cover (84) has a shorter width than a horizontal width of an upper channel (35) formed in an upper position of the sash (31) of the slidable member (30), wherein, when the slidable member (30) for the interior partition is lifted in the upwards direction, the top cover (84) enters the upper channel (35) of the sash (31) and the slidable member (30) for the interior partition is removed the frame (10);

a cushion member (88) connected to one side of the slidable member (30), to prevent a noise occurring when the slidable member (30) contacts the frame (10) and to improve the air tightness and soundproofing in a state that the slidable member (30) is closed against the frame (10); and side covers (89) each having a outer surface connected to both side jambs inside the frame (10), to prevent any protrusions or grooves from being shown at both the side jambs of the frame (10).

* * * * *